United States Patent [19]

Miller

[11] Patent Number: 4,940,438

[45] Date of Patent: Jul. 10, 1990

[54] SURFBOARD WITH ANGULARLY RELATED FINS

[76] Inventor: S. Scott Miller, 5 W. Burlington Ave., Harvey Cedars, N.J. 08008

[21] Appl. No.: 351,191

[22] Filed: May 12, 1989

[51] Int. Cl.[5] ..... A63C 15/00

[52] U.S. Cl. ..... 441/79; 114/127; 114/140

[58] Field of Search ..... 114/127, 152, 140, 357; 444/68, 74, 79

[56] References Cited

U.S. PATENT DOCUMENTS 3,337,886 8/1967 Ebstrom ..... 441/74

3,514,798 6/1970 Ellis ..... 441/74

FOREIGN PATENT DOCUMENTS 3635862 5/1988 Fed. Rep. of Germany ..... 441/74

259554 9/1987 France ..... 441/74

8701345 3/1987 World Int. Prop. O. ..... 114/127

*Primary Examiner*—Sherman D. Basinger

*Attorney, Agent, or Firm*—Austin R. Miller

[57] ABSTRACT

A surfboard is provided with fins, at least one of which is canted at an angle to the longitudinal axis and also tilted relative to the surface of the board, and reinforcing fibers are applied to extend continuously from along the fin to along the board, and adhered to each.

9 Claims, 2 Drawing Sheets

SURFBOARD WITH ANGULARLY RELATED FINS

This invention relates to a surfboard having one or more fins which serve to stabilize and enhance the movement of the board through the water. More particularly the invention relates to a surfboard having a plurality of fins which remarkably improve the ability of the surfer in making sharp turns and other manuevers.

It is not unusual to apply conventional fins to a board in an angular manner, wherein the fins are canted at an angle to the longitudinal axis of the board and also tilted at an angle to the bottom surface of the board. This is considered to provide superior control and handling ability, especially in making turns and even in performing line drive manuevers, straight down a wave.

Angularly related fins, however, are especially susceptible to breakage, especially when the surfboard is grounded on sand, rocks or lava, for example. The fact that the fins are canted at an angle to the longitudinal axis and are also tilted at an angle to the surface of the board renders them especially likely to break away from the board upon impact.

To overcome this problem, some fins have been constructed of especially thick and heavy materials and while this expedient has improved the resistance of the fins to breakage it has taken away the advantages of light weight and turning flexibility.

It is accordingly an object of this invention to provide a surfboard having one or more fins which are angularly related to the surface of the board, which are nevertheless resistant to breakage upon impact, and which provide excellent light weight and performance characteristics in use.

Other objects and advantages of this invention, including the simplicity and economy of the same and the ease with which it may be applied to boards of various sizes and shapes, will become further apparent hereinafter and in the drawings of which:

DETAILED DESCRIPTION OF THE INVENTION

Figure 1:
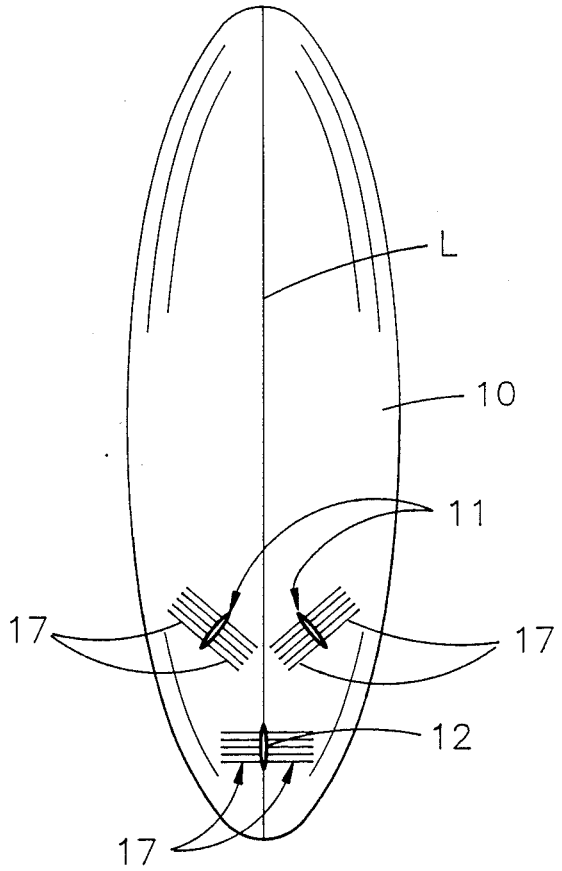
FIG. 1 is a bottom view of a surfboard, showing a selected fin arrangement according to this invention.

It will be appreciated that only one particular form of surfboard has been selected for illustration in the drawings. Further, the description which follows is directed to the specific form of the invention selected for illustration in the drawins, and is not intended to limit the scope of the invention, which is defined in the appended claims.

Turning now to FIG. 1, the surfboard comprises a board 10 having canted fins 11,11 and a substantially perpendicular fin 12 at the rear central portion of the board. FIG. 1 shows that the fins 11 are canted at an angle to the longitudinal axis L of the board 10.

Figure 2:
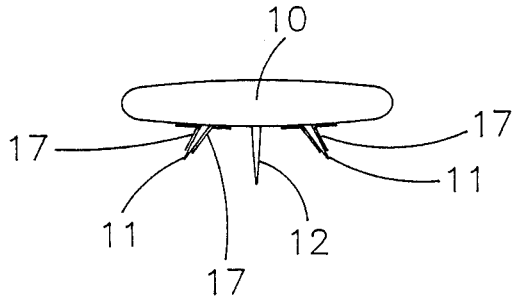
FIG. 2 is a rear view of the same board.

FIG. 2 shows that the canted fins 11,11 are also tilted with respect to the bottom surface of the board, whereas the rear fin 12 is substantially perpendicular to the bottom surface of the board. It has been discovered that the canted and tilted fins 11,11 are much more susceptible to damage, and to breaking off from the board, upon contacting the bottom or rocks or other impediments.

It has been discovered that the foregoing objects of the invention may be attained by providing fins such as 11,11 by adhering a plurality of spaced fibers 17 (FIGS. 1 and 2) of high tensile modulus many or all of which are adhered to body portions but not to the tip portions of the angular fins. The spaced fibers are adhered directly over the lower surface and base of the fin and are adhered to an adjacent portion of the board itself. Preferably this is done at both side faces of the fin, as indicated by the fibers 17,17 in FIG. 1. It has been discovered particularly that when the high tensile modulus fibers are incorporated into a cloth and when the cloth is adhered to the fin and at least a plurality of the high tensile modulus fibers extend only part way, for example about half way along the fin, this provides very advantageous fin flexibility at the end of the fin, and gives remakably excellent turning performance in actual surfing use.

Figure 3:
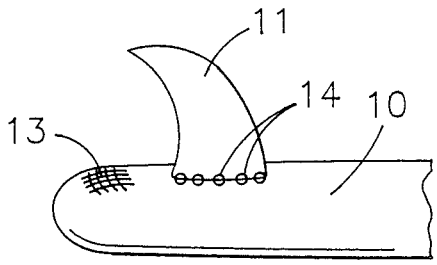
FIG. 3 is an enlarged oblique sideward and rearward view of one fin of an inverted surfboard, bottom up, with parts broken away, showing one step in the process of manufacturing a surfboard in accordance with this invention.
Figure 4:
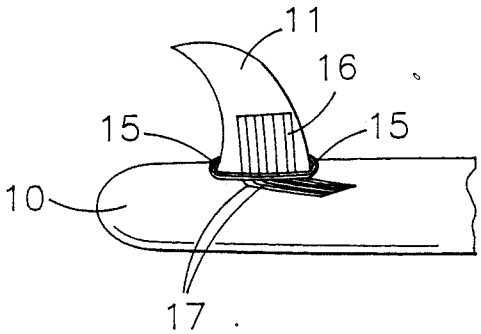
FIG. 4 is a similar oblique view, showing a further step in the method of manufacturing the surfboard.
Figure 5:
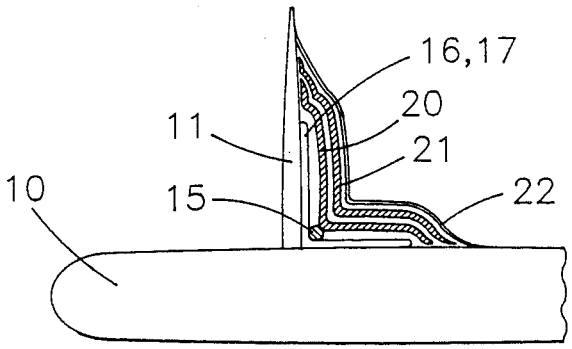
FIG. 5 is a rear partially sectional view, looking along the plane of the fin, showing a still further step in the manufacture of a surfboard in accordance with this invention.

The construction details of a perferred form of surfboard selected for illustration in the drawings appear in FIGS. 3–5. FIG. 3 shows that the fin 11 is initially tacked to a cloth surface 13 of a shaped but unfinished board 10 having an exterior preferably fiberglass cloth surface 13. The fin 11 is tacked to the cloth surface 13 by (epoxy) beads 14, which serve as a temporary measure to hold the canted fin at the desired predetermined angle of cant and at the predetermined angle of tilt. With the beads 14 hardened, turning to FIG. 4, a high tensile modulus reinforced cloth 16 is shown, having as a part of the cloth structure a plurality of substantially parallel lightweight fibers 17 of high tensile modulus. Preferably the fibers 17 are incorporated into the weave of the cloth, and, in the embodiment shown, all the fibers extend parallel to each other in the lengthwise direction of the fin, in the manner shown in FIG. 4.

Preferably, a fiberglass rope 15 is prepared, preferably composed of a plurality of parallel, untwisted fiberglass fibers of sufficient length to form a ring around the base of the fin 11 at the point where it contacts the cloth surface 16 and the fibers 17. The fiberglass rope 15 is wrapped around the cloth 16 and fibers 17 at the base of the fin to form the aforesaid ring, and is firmly adhered in place by saturating it with an epoxy or other appropriate cement. This, though optional, provides a strong structural bond between the fin 11, the fiberglass cloth surface 13 and the cloth 16 and fibers 17.

The reinforced cloth 16, as shown in FIG. 4, extends only about halfway up the length of the fin 11 to provide a variable fin flexibility. The resulting combination of base stiffness and end flexibility gives surprisingly enhanced turning response and other performance advantages in actual use. As shown in FIG. 4, the fiber reinforced cloth 16 is cemented or adhered to the fin and extends down under the fiberglass rope ring 15 which is cemented or adhered onto the cloth 16 and fibers 17.

Preferably the reinforced cloth 16 or fibers 17 are applied to both the inboard and outboard surfaces of the fin and board, as shown at 17 in FIGS. 1 and 2, and whether incorporated into a cloth or not the fibers comprise a plurality of parallel spaced apart high tensile modulus fibers extending lengthwise over any desired portion of the length of the fin. Although a variety of high tensile modulus fibers may be used, preferable fibers include those of especially light weight and high tensile modulus, such as carbon fibers, graphite fibers, "Kevlar" or aramid fibers, steel, etc.

Turning now to FIG. 5, one or more layers of fiberglass cloth 20 and 21 are applied and adhered over the fiber reinforced cloth 16 and high tensile modulus fibers 17 and the entire fin and board, after which a finish coating 22 is applied to the entire structure. For convenience of illustration the layers 20, 21 and 22 are shown as applied to the inboard fin surface only, although they are preferably applied to all surfaces of the fin and the board. The resulting laminated structure of FIG. 5 is sanded or buffed in order to fair the entire exterior surface of the fin and the board. Sanding or fairing can be used advantageously in the particular construction shown, because the high tensile modulus fibers 17 are positioned directly against the fin 11 and the board 10 and are protected by the overlying layers of fiberglass cloth 20,21 during the sanding or buffing operation.

The resulting product is a beautifully smooth and faired board, having any desired number of fins arranged at any desired angles of cant or tilt in order to achieve optimum performance for the particular surfer who will be using the board, while concurrently providing excellent resistance to breaking of the fins or separation of the fins from the board while concurrently achieving remarkably improved turning and other performance characteristics as a result of stiffness of the fins at their bases combined with flexibility of the canted fins at their ends.

It will be appreciated that the designer may select various shapes of reinforcing cloth or individual fibers of the same or different lengths, sizes, deniers or combinations of high tensile modulus materials, and may select various straight or curved shaped portions of each fin to be covered or left uncovered in a straight, curved or other geometric pattern by the reinforcing fibers, and is not restricted to covering the entire base portion while leaving the entire tip portion uncovered. For example it is possible in some cases to extend a few fibers to the end of the fin but other fibers only partway, or to provide lighter or smaller denier fibers at the end portion of the fin instead of leaving it blank, while more strongly reinforcing the base portion of the fin.

Although the fibers 17 have been shown in the drawings as parallel and straight, various other configurations may be used, including knitted, woven or waffle type fabrics or others, and different types, sizes and deniers of fibers or others, and different types, sizes and deniers of fibers can be combined according to the designer's will.

Furthermore, the structure of this invention may be applied to one or more fins, whether canted or tilted or not, and any desired number of fins may be applied to the board. The fins may be arranged in any desired sequence or grouping on the board, and there is no limit to the number of fins, which may number from one to five or even more. Further, this invention applies advantageously to fins and boards of various shapes, sizes and materials.

Although this invention has been described with respect to particular forms thereof, it will be appreciated that a wide variety of changes may be made without departing from the spirit and scope of this invention. For example, certain features of the invention may be used independently of other features, equivalent elements may be substituted for those specifically shown and described, and shapes, design and other modifications may be made without departing from the spirit and scope of this invention as defined in the appended claims:

I claim:

1. A surfboard comprising a board having a longitudinal axis and forward and rearward ends and a plurality of fins extending from a surface of said board, at least one of said fins being an angular fin canted at an angle to said longitudinal axis and also tilted relative to the surface of said board, a plurality of spaced fibers of high tensile modulus at least some of which are adhered to said fin and also adhered to the adjacent portion of said board, said fibers being distributed on said fin in a predetermined pattern whereby the tip portion of said angular fin has greater bending flexibility than does the body portion of said angular fin.

2. A surfboard comprising a board having a longitudinal axis and forward and rearward ends and a plurality of fins extending from a surface of said board, at least one of said fins being an angular fin canted at an angle to said longitudinal axis and also tilted relative to the surface of said board, a plurality of spaced fibers of high tensile modulus at least some of which are adhered to said fin and to the adjacent portion of said board, said fibers being distributed on said fin in a predetermined pattern whereby the tip portion of said angular fin has greater bending flexibility than does the body portion of said angular fin, wherein said angular fin is further secured to said board by a ring of fibers surrounding the base of the fin and adhered to said high tensile modulus fibers, whereby the high tensile modulus fibers extend under said ring.

3. The surfboard defined in claim 1 wherein the board is composed of a plurality of layers including a layer of cloth, and wherein said high tensile modulus fibers are adhered directly to said cloth.

4. The surfboard defined in claim 3 wherein a surface finish layer is adhered in a manner to cover said high tensile modulus fibers on said fin and is adhered to said board, and is faired to provide smooth continuous surfaces on said fin and on said board.

5. The surfboard defined in claim 1 wherein said high tensile modulus fibers are selected from the group consisting of carbon, graphite and Kevlar aramid fibers.

6. The surfboard defined in claim 1 wherein said high tensile modulus fibers are applied to both the inboard and outboard surfaces of said angular fin and to adjacent portions of said board.

7. The surfboard defined in claim 1 wherein said high tensile modulus fibers are incorporated into a cloth, and wherein the cloth is adhered to the fin and the board.

8. A surfboard comprising a board having a longitudinal axis and forward and rearward ends and a plurality of fins extending from surface of said board, at least one of said fins being an angular fin canted at an angle to said longitudinal axis and also tilted to an angle to the surface of said board, a plurality of spaced fibers of high tensile modulus adhered to a body portion but not the tip portion of said angular fin and extending directly to a portion of said board and adhered to said board, whereby the tip portion of said angular fin has greater bending flexibility than does the body portion of said angular fin, said angular fin being secured to said board under a ring of fibers surrounding the base of the fin and adhered to both the high tensile modulus fibers and the board, and wherein the high tensile modulus fibers extend under said ring, wherein the board is composed of a plurality of layers including a layer of cloth and said high tensile modulus fibers are adhered to said cloth, said high tensile modulus fibers being applied to both the inboard and outboard surfaces of said angular fin and to adjacent portions of said board, said high tensile modulus fibers comprising a portion of a fabric, which fabric is adhered to the fin and to the board, and wherein the foregoing structure is covered with a layer of fiberglass cloth and a finish coating which is faired to the exterior surface of the surfboard while maintaining the struactural integrity of said high tensile modulus fibers.

9. A surfboard comprising a board having a longitudinal axis and forward and rearward ends and a plurality of fins extending from a surface of said board, a plurality of spaced fibers of high tensile modulus adhered to at least one of said fins and extending continuously to a portion of said board and adhered to said board, said fin being secured to said board under a ring of fibers surrounding the base of the fin and adhered to both the high tensile modulus fibers and the board, and wherein the high tensile modulus fibers extend under said ring, wherein the foregoing structure is covered with a layer of fiberglass cloth and a finished coating which is faired to the exterior surface of the surfboard while maintaining the structural integrity of said high tensile modulus fibers.

* * * * *